US008459650B2

(12) United States Patent
Baseel

(10) Patent No.: US 8,459,650 B2
(45) Date of Patent: Jun. 11, 2013

(54) BLACKJACK SIDE-BET

(75) Inventor: Joseph Christopher Baseel, Las Vegas, NV (US)

(73) Assignee: Tech Art, Inc., Las Vegas, NV (US)

( * ) Notice: Subject to any disclaimer, the term of this patent is extended or adjusted under 35 U.S.C. 154(b) by 0 days.

(21) Appl. No.: 13/100,929

(22) Filed: May 4, 2011

(65) Prior Publication Data

US 2012/0280452 A1 Nov. 8, 2012

(51) Int. Cl.
*A63F 1/00* (2006.01)
*A63F 9/24* (2006.01)

(52) U.S. Cl.
USPC ..... 273/292; 463/12; 273/274

(58) Field of Classification Search
USPC ..... 273/292, 274
See application file for complete search history.

(56) References Cited

U.S. PATENT DOCUMENTS 5,174,579 A 12/1992 Griffiths
5,660,392 A 8/1997 Hansen
5,673,917 A * 10/1997 Vancura ..... 273/292
RE35,968 E 11/1998 Prerost
6,598,879 B2 7/2003 Spur et al.
6,877,746 B1 4/2005 Herren et al.
7,144,011 B2 12/2006 Asher et al.
7,648,140 B2 1/2010 Silverman
2006/0151954 A1 7/2006 Silverman
2008/0242387 A1 * 10/2008 Asher et al. ..... 463/12
2009/0045576 A1 2/2009 Andrianakos
2009/0051110 A1 2/2009 Sparago
2009/0186676 A1 7/2009 Amaitis et al.

OTHER PUBLICATIONS http://en.wikipedia.org/wiki/Blackjack, Feb. 7, 2013.
http://www.wsgc.wa.gov/docs/game_rules/triple_attack_black-jack.pdf, Feb. 7, 2013.

* cited by examiner

*Primary Examiner* — Michael Dennis
(74) *Attorney, Agent, or Firm* — Akerman Senterfitt

(57) ABSTRACT

A game of Blackjack may include a mid-game side-bet that the dealer will go bust. The side-bet offered may be placed against any dealer face-up card—Ace, 2, 3, 4, 5, 6, 7, 8, 9, 10, Jack, Queen, or King. The payoff may vary depending upon the dealer face-up card and paid in accordance with a pay table. The bet may be paid when the dealer hits their hand and exceeds the total of 21, therefore going bust. The bet may lose when the dealer receives a standing hand of 17, 18, 19, 20 or 21. The side-bet may be made once the dealer's face-up card has been determined. The side-bet may be asked for at one time similar to an insurance bet or as each player acts on their individual hands.

20 Claims, 6 Drawing Sheets

BLACKJACK SIDE-BET

BACKGROUND OF INVENTION

1. Field of the Invention

The present invention relates to card games, and more particularly to a Blackjack game involving side-bets.

2. Description of the Related Art

Conventional card games include Blackjack or 21. Conventional Blackjack games include those disclosed by U.S. Pat. No. 7,144,011 to Asher et al. (entitled "System and Method for Providing a Blackjack Game Having Additional Options for a Player"); U.S. Pat. No. 5,174,579 to Griffiths (entitled "Modified Method of Playing a Twenty-One Game"); and U.S. Publication No. 2009/0051110 to Sparago (entitled "Modified Blackjack Game with a Side Bet on 'Any Ten'"). However, conventional side-bets may have various drawbacks, such as leaving the players with the impression that the odds of winning are still stacked in the house's favor, the odds presented are unfavorable, the side-bets offered are undesirable, unimaginative, or viewed as having an unacceptable high-risk for the offered payout, and the like.

SUMMARY OF THE INVENTION

The present embodiments are directed to a method for placing a Blackjack side-bet. In one aspect, the side-bet offered may be placed against any dealer face-up card—Ace, 2, 3, 4, 5, 6, 7, 8, 9, 10, Jack, Queen, or King. The payoff may vary depending upon the dealer face-up card and paid in accordance with a pay table. The bet may be paid when the dealer hits their hand and exceeds the total of 21, therefore going bust. The bet may lose when the dealer receives a standing hand of 17, 18, 19, 20 or 21. The side-bet may be made once the dealer's face-up card has been determined. The side-bet may be asked for at one time similar to an insurance bet or as each player acts on their individual hands. If the dealer has no players left to play against when it is their turn to act on their hand, the bet may be considered a push. If by mistake the hole card is exposed prematurely, there may be no more side-bets allowed, but all existing side-bets will have action.

In another aspect, a method of playing a game of Blackjack involving a side-bet may be provided. The method may include accepting a primary wager from a player; dealing a card to the player; dealing an initial face-up card to a dealer; and determining a face value of the initial face-up card belonging to the dealer. If the face value of the initial face-up card belonging to the dealer is equal to a specific value, the method may include offering the player the option of placing a secondary mid-game wager that the dealer will go bust if the dealer takes one or more additional cards after the initial two cards, the initial face-up card and a hole card, have been dealt to the dealer. The specific value of the initial face-up card belonging to the dealer that triggers the offering of the side-bet may be any value—Ace, 2, 3, 4, 5, 6, 7, 8, 9, 10, Jack, Queen, or King. In one embodiment, the specific value may be between 2 and 9, inclusive. In another embodiment, the specific value may be a 5, 6, and/or 7. In another embodiment, the specific value may be an Ace, a face-card, or a 10. As a result, the player may be offered the option of placing the secondary mid-game wager only when the initial face-up card belonging to the dealer is the pre-determined specific value. Further, if the player has broken or won before the dealer needs to act on his or her hand, the secondary mid-game wager may be pushed, or doubled if other players remain alive. Alternatively, at the completion of the player's turn, such as a Blackjack or bust, the player may force the dealer to complete the hand with the side-bet still alive.

In another aspect, a method of playing a game of Blackjack involving a side-bet may be provided. The method may include accepting a primary wager from a player; dealing at least one card to the player; dealing a combination of dealer face-up cards to a dealer; and determining a face value of the combination of dealer face-up cards belonging to the dealer. If the face value of the combination of dealer face-up cards belonging to the dealer is equal to a specific value, the method may include offering the player the option of placing a secondary mid-game wager that the dealer will go bust before acquiring Blackjack or a winning hand. The specific value of the face value of the combination of dealer face-up cards at which the side-bet is offered may be any value. In one embodiment, the specific value may be between 2 and 9, inclusive. In another embodiment, the specific value may be a 5, 6, and/or 7. In another embodiment, the specific value may be an Ace, a face-card, or a 10. As a result, the player may be offered the option of placing the secondary mid-game wager only when the face value of the combination of dealer face-up cards belonging to the dealer is the pre-determined specific value.

In another aspect, a method of playing a game of Blackjack involving a side-bet may be provided. The method may include accepting a primary wager from a plurality of players; dealing a combination of player face-up cards to each of the plurality of players; dealing a combination of dealer face-up cards to a dealer; determining a first face value of each combination of player face-up cards as the game progresses; and determining a second face value of the combination of dealer face-up cards as the game progresses. If the first face value of any combination of player face-up cards or the second face value of the combination of dealer face-up cards is equal to a specific value at anytime during the game, the method may include offering the player the option of placing a secondary mid-game wager that the respective player or dealer having a face value of face-up cards equal to the specific value will go bust before acquiring Blackjack or a winning hand. The specific value at which the side-bet is offered may be any value. In one embodiment, the specific value may be between 2 and 9, inclusive. In another embodiment, the specific value may be a 5, 6, and/or 7. In another embodiment, the specific value may be an Ace, a face-card, or a 10. As a result, the player may be offered the option of placing the secondary mid-game wager only when the face value of face-up cards belonging to the respective player or dealer is the pre-determined specific value.

The present invention is defined by the following claims. Nothing in this section should be taken as a limitation on those claims. Further aspects and advantages of the invention are discussed below in conjunction with the preferred embodiments and may be later claimed independently or in combination.

DESCRIPTION OF THE DRAWINGS

The present embodiments will become more fully understood from the detailed description given herein below and the accompanying drawings which are given by way of illustration only, and are not limitative of the present invention, and wherein.

DETAILED DESCRIPTION

Figure 1:
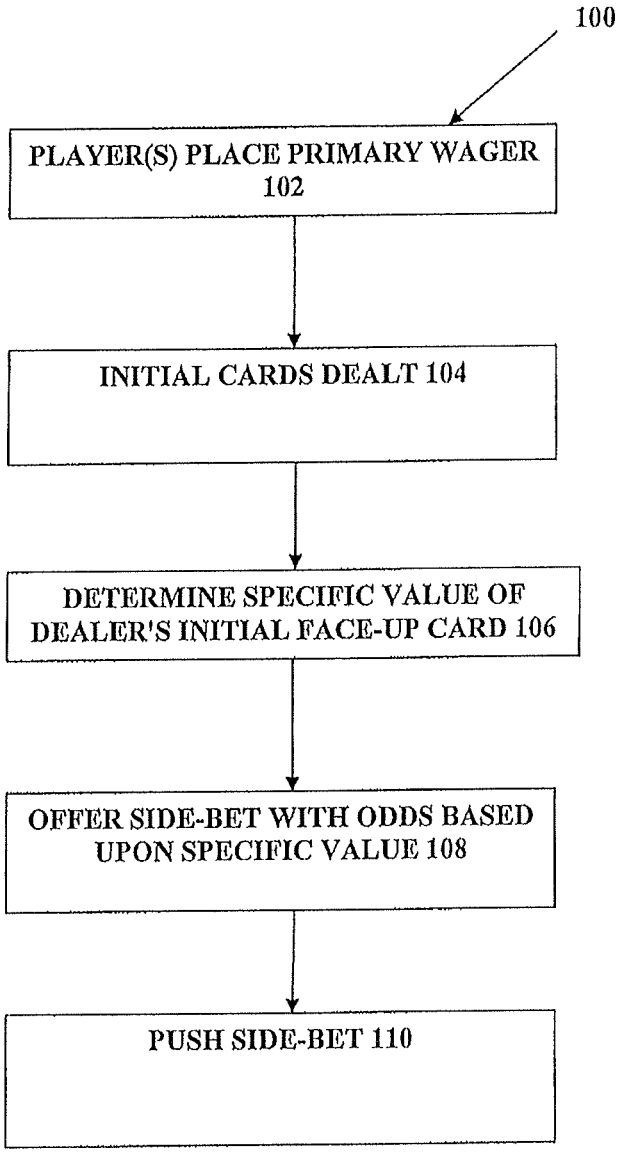
FIG. 1 illustrates an exemplary method of placing a Blackjack side-bet.

The present embodiments are directed to a method for placing a Blackjack side-bet. In one aspect, the side-bet offered may be placed against any dealer face-up card—Ace, 2, 3, 4, 5, 6, 7, 8, 9, 10, Jack, Queen, or King. The payoff may vary depending upon the dealer face-up card and paid in accordance with a pay table. The bet may be paid when the dealer hits their hand and exceeds the total of 21, therefore going bust. The bet may lose when the dealer receives a standing hand of 17, 18, 19, 20 or 21. The side-bet may be made once the dealer's face-up card has been determined, and may be asked for at one time similar to an insurance bet or as each player acts on their individual hands. If the dealer has no players left to play against when it is their turn to act on their hand, the bet may be considered a push. If by mistake the hole card is exposed prematurely, there may be no more side-bets allowed, but all existing side-bets will have action.

In other aspects, the side-bet may be that the dealer or another player will go bust if the dealer or player takes another card, or that the dealer will go bust before getting Blackjack or other winning hand. The side-bet may be whether or not the dealer will go bust after the player sees the dealer's initial face-up card and/or other face-up cards.

For example, if the dealer shows a pre-determined specific value as his or her initial face-up card, or combination of face-up cards, the player may then be given the option of placing a mid-game side-bet that the dealer will go bust, such as before getting Blackjack or a winning hand. Based upon the card or cards shown, the player may wish to accept the offered odds that the dealer will go bust. Alternatively or additionally, the mid-game side-bet offered may be based upon the pre-determined specific value of one or more face-up cards of the player or another player, with the side-bet being that the player or the other player will go bust or otherwise lose.

The method of playing Blackjack may include offering a mid-game side-bet to a player when the dealer's initial face-up card is any specific card, ranging from Ace to King. In one embodiment, the pre-determined specific value that triggers the offering of the side-bet that the dealer will go bust is any value—Ace, 2, 3, 4, 5, 6, 7, 8, 9, 10, Jack, Queen, or King. The payoff may vary depending upon the dealer face-up card and paid in accordance with a pay table.

In another embodiment, the pre-determined specific value that triggers the offering of the side-bet that the dealer will go bust is a non-face card or a card less than 10. For instance, if the dealer's initial face-up card is between 2 and 9, inclusive, the player may be offered a side bet that the dealer will go bust before getting Blackjack or other winning hand. The odds offered may be card dependent.

In another embodiment, the pre-determined specific value that triggers the offering of the side-bet is a 5, 6, or 7. It is believed that the odds may be generally highest that the dealer will go bust before getting Blackjack or a winning hand if his or her initial face-up card is a 5, 6, or 7. Thus, insurance may not be offered to players when a dealer's initial face-up card is a 5, 6, or 7. Also, with the increased likelihood that the dealer may go bust with a 5, 6, or 7 showing, conventional games may not offer a mid-game side-bet to a player that the dealer will go bust with what may be perceived as a "bad" hand for the house. Conventional games also may not offer side-bets that a player or another player will go bust or lose if they have one or more cards showing having a combined face value of 5, 6, or 7.

In another aspect, the present embodiments may involve placing a mid-game side-bet after the initial one or two cards, or more, have been dealt. As a result, the players may be able to view one or more face-up cards for one or more of the players and dealer, and factor the value of the face-up cards into whether or not to make the mid-game side-bet. Preferably, the mid-game side-bet is whether or not the dealer or another player will go bust after the player sees the one of the dealer's initial cards that is face-up and/or the other player's face-up card or cards. The mid-game side-bet may be that the dealer will go bust if the dealer takes another card, or that the dealer will go bust before getting Blackjack or a winning hand.

In a first aspect, the player may place a side-bet that the dealer or a specific player will go bust. The side-bet may be placed either before or after the initial cards are dealt. In a second aspect, the player may make the side-bet based upon any one of the dealer's face-up cards, or any one of the specific player's face-up cards.

If all players have broken or won before the dealer needs to act on their hand, the bets in the first and second aspects mentioned directly above may be considered pushed and there may be no action taken on the bets. Alternatively, if the dealer does not desire to use the push option, they may complete the hand, and/or the player may require the dealer to complete the hand. Side-bets with additional, fewer, or alternate features may be offered.

I. Exemplary Blackjack Side-Bet Based Upon Dealer's Initial Face-Up Card

The game of Blackjack for use with the present embodiments may involve conventional Blackjack rules or modified Blackjack rules. In one aspect, a method of playing a game of Blackjack involving a side-bet may be provided. The method may include accepting a primary wager from a player; dealing a card to the player; dealing an initial face-up card to a dealer; and determining a face value of the initial face-up card belonging to the dealer. The method may include offering the player the option of placing a secondary mid-game wager that the dealer will go bust if the dealer takes one or more additional cards after the initial two cards, the initial face-up card and a hole card, have been dealt to the dealer. The method may include determining odds to be offered to the player that the dealer will go bust that depend upon the dealer's initial face-up card, whether an Ace, 2, 3, 4, 5, 6, 7, 8, 9, 10, Jack, Queen, or King. The bet may be paid when the dealer hits their hand and exceeds the total of 21, therefore going bust. The bet may lose when the dealer receives a standing hand of 17, 18, 19, 20 or 21.

FIG. 1 illustrates an exemplary method of offering a Blackjack side-bet 100 that the dealer will go bust. The method of offering a Blackjack side-bet 100 may include the player(s) placing a primary wager 102, the dealer dealing the initial cards 104, determining the specific value of the dealer's initial face-up card 106, offering a side-bet that the dealer will go bust 108, and/or pushing the side-bet 110. The method may include additional, fewer, or alternative steps.

The method of offering a Blackjack side-bet 100 may include each of the players making a primary wager 102. The primary wager may be an amount that is wagered on the player winning the hand or getting Blackjack. Alternatively or additionally, the primary wager may be an initial wager that the dealer, the player, and/or one or more competing players will go bust.

The method of offering a Blackjack side-bet 100 may include dealing the initial cards 104. The initial cards dealt, which may be dealt before determining whether or not to offer a side-bet, may include dealing a single card, dealing an initial single card to each player and the dealer, or dealing the first two rounds to each player and the dealer. For instance, the initial two rounds may be dealt, with the dealer having a face-up card and a hole card, and each of the players having two face-up cards.

In one embodiment, the method of offering a Blackjack side-bet 100 may include determining a specific value of the dealer's initial face-up card 106. For instance, the dealer's initial face-up card may be an Ace, 2, 3, 4, 5, 6, 7, 8, 9, 10, Jack, Queen, or King.

The method of offering a Blackjack side-bet 100 may include offering a secondary mid-game wager with odds offered being based upon the specific value of the dealer's initial face-up card 108. The side-bet may be made once the dealer's face-up card has been determined. The side-bet may be asked for at one time similar to an insurance bet, or as each player acts on their individual hands. The odds offered to each player may be the same, or different. For example, if the side-bet is asked for as each player acts on their individual hands, the odds offered to an individual player may be changed based upon all of the cards previously played, including those of the other players.

The secondary mid-game wager may be that the dealer will go bust. For instance, the secondary mid-game wager may be that the dealer will go bust before getting Blackjack and/or a hand of a certain value, such as between 17 and 21. The method may further include determining odds to be offered to the player that the dealer will go bust that depend upon the dealer's initial face-up card, whether an Ace, 2, 3, 4, 5, 6, 7, 8, 9, 10, Jack, Queen, or King. In one embodiment, the bet may be paid when the dealer hits their hand and exceeds the total of 21, therefore going bust.

In one embodiment, the game of Blackjack may have rules that require the dealer to draw until reaching 17 and the secondary mid-game wager loses when the dealer receives a standing hand of 17, 18, 19, 20 or 21. In another embodiment, the game of Blackjack may have rules that require the dealer to draw until reaching 18 and the secondary mid-game wager loses when the dealer receives a standing hand of 18, 19, 20 or 21. Other standing hands may be used.

The method 100 may include pushing, canceling, forcing and/or doubling the side-bet 110. For example, if the dealer has no players left to play against when it is their turn to act on their hand, the bet may be considered a push. If by mistake the dealer's hole card is exposed prematurely, there may be no more side-bets allowed, but all existing side-bets may still have action and be allowed to proceed.

II. Other Exemplary Blackjack Side-Bet Based Upon Dealer's Initial Face-Up Card

In another aspect, a method of playing a game of Blackjack involving a side-bet may be provided. The method may include accepting a primary wager from a player; dealing a card to the player; dealing an initial face-up card to a dealer; and determining a face value of the initial face-up card belonging to the dealer. If the face value of the initial face-up card belonging to the dealer is equal to a specific value, the method may include offering the player the option of placing a secondary mid-game wager that the dealer will go bust if the dealer takes one or more additional cards after the initial two cards, the initial face-up card and a hole card, have been dealt to the dealer.

In one embodiment, the specific value that triggers offering the mid-game side-bet to the player of whether the dealer will go bust may be between 2 and 9, inclusive, i.e., a non-face card that is less than 10. As a result, the player may be offered the option of placing the secondary mid-game wager only when the initial face-up card belonging to the dealer is between 2 and 9, inclusive.

In another embodiment, the specific value that triggers offering the mid-game side-bet to the player of whether the dealer will go bust may be an Ace, a face-card, or a 10. As a result, the player may be offered the option of placing the secondary mid-game wager only when the initial face-up card belonging to the dealer is an Ace, a face-card, or a 10.

In another embodiment, the specific value that triggers offering the mid-game side-bet to the player of whether the dealer will go bust may be 5. As a result, the player may be offered the option of placing the secondary mid-game wager only when the initial face-up card belonging to the dealer is a 5.

In another embodiment, the specific value that triggers offering the mid-game side-bet to the player of whether the dealer will go bust may be 6. As a result, the player may be offered the option of placing the secondary mid-game wager only when the initial face-up card belonging to the dealer is a 6.

In another embodiment, the specific value that triggers offering the mid-game side-bet to the player of whether the dealer will go bust may be 5 and/or 6. As a result, the player may be offered the option of placing the secondary mid-game wager only when the initial face-up card belonging to the dealer is a 5 and/or a 6.

In another embodiment, the specific value that triggers offering the mid-game side-bet to the player of whether the dealer will go bust may be 7. As a result, the player may be offered the option of placing the secondary mid-game wager only when the initial face-up card belonging to the dealer is a 7.

In another embodiment, the specific value that triggers offering the mid-game side-bet to the player of whether the dealer will go bust may be 5, 6 and/or 7. As a result, the player may be offered the option of placing the secondary mid-game wager only when the initial face-up card belonging to the dealer is a 5, a 6, and/or a 7.

In another embodiment, the game of Blackjack may have rules that require the dealer to draw until reaching seventeen and to stand on seventeen or above, and the specific value that triggers offering the mid-game side-bet to the player of whether the dealer will go bust is 5 and/or 6. As a result, the player may be offered the option of placing the secondary mid-game wager only when the initial face-up card belonging to the dealer is a 5 and/or a 6.

In another embodiment, a modified game of Blackjack may have rules that require the dealer to draw until reaching eighteen and to stand on eighteen or above, and the specific value that triggers offering the mid-game side-bet to the player of whether the dealer will go bust is less than 10, such as a 5, 6, and/or 7. As a result, the player may be offered the option of placing the secondary mid-game wager only when the initial face-up card belonging to the dealer is less than 10, such as a 5, a 6, and/or a 7, during the modified game of Blackjack.

In another embodiment, during an otherwise conventional game of Blackjack, the specific value that triggers offering the mid-game side-bet to the player of whether the dealer will go bust is between 2 and 9, preferably between 5 and 7, such that the player is offered the option of placing the secondary mid-game wager only when the initial face-up card belonging to the dealer is between 2 and 9, preferably between 5 and 7. Further, if the player has broken or won before the dealer needs to act on his or her hand, the secondary wager may be pushed, or may be doubled if other players remain alive in the game. Alternatively, the dealer may have the option of playing out the hand in an attempt to win the side-bet. Or a losing player, such as the last player alive, may have the option of forcing the dealer to play out the hand in an attempt by the player to win the side-bet.

For instance, if all players have broken or won such that the dealer is essentially competing against himself, the secondary mid-game side-bet may become whether or not the dealer will get Blackjack or bust. The odds offered for such a side-bet may be the same or different than the original odds offered. As an example, the odds offered for forcing the dealer to play out the hand to see if he or she busts before getting Blackjack may be reduced as compared to the original side-bet.

Alternatively, if all players have broken or won such that the dealer is essentially competing against himself, the secondary mid-game side-bet may become whether or not the dealer will get a hand above a certain value, such as a hand between 18 and 21, before going bust. The odds offered for such a side-bet may be the same or different than the original odds offered. As an example, the odds offered for forcing the dealer to play out the hand to see if he or she busts before getting hand between 18 and 21 may be reduced as compared to the original side-bet.

In another aspect, a method of playing a game of Blackjack involving a side-bet may be provided. The method may include accepting a primary wager from a player; dealing a card to the player; dealing an initial face-up card to a dealer; and determining a face value of the initial face-up card belonging to the dealer. If the face value of the initial face-up card belonging to the dealer is equal to a specific value, the method may include offering the player the option of placing a secondary mid-game wager that the dealer will go bust before getting Blackjack, a winning hand, or a hand of a certain value after the initial face-up card has been dealt to the dealer but before a third card is dealt to the dealer. The specific value of the initial face-up card belonging to the dealer that triggers the offering of the mid-game side-bet may be between 2 and 9, inclusive, preferably 5, 6, and/or 7. As a result, the player may be offered the option of placing the secondary mid-game wager only when the initial face-up card belonging to the dealer is between 2 and 9, inclusive, preferably a 5, 6, and/or 7. Further, if the player has broken or won before the dealer needs to act on his or her hand, the secondary mid-game wager may be pushed, canceled, forced, or doubled if other players remain alive.

III. Exemplary Blackjack Side-Bets Based Upon Combined Dealer's Face-Up Cards

In another aspect, a method of playing a game of Blackjack involving a side-bet may be provided. The method may include accepting a primary wager from a player; dealing at least one card to the player; dealing a combination of dealer face-up cards to a dealer; and determining a face value of the combination of dealer face-up cards belonging to the dealer. If the face value of the combination of dealer face-up cards belonging to the dealer is equal to a specific value, the method may include offering the player the option of placing a secondary mid-game wager that the dealer will go bust before acquiring Blackjack, a winning hand, or a hand of a certain value, such as between 18 and 21.

The specific value of the face value of the combination of dealer face-up cards at which the side-bet is offered may be any value. In one embodiment, the specific value of the face value of the combination of dealer face-up cards at which the side-bet is offered may be between 2 and 9, inclusive, preferably 5, 6, and/or 7. As a result, the player may be offered the option of placing the secondary mid-game wager only when the face value of the combination of dealer face-up cards belonging to the dealer is between 2 and 9, inclusive, preferably 5, 6, and/or 7. Further, if the player has broken or won before the dealer needs to act on his or her hand, the secondary wager may be pushed, canceled, forced, or doubled if other players remain alive.

In another embodiment, the specific value of the face value of the combination of dealer face-up cards at which the side-bet is offered may be 10 or more. For instance, the side-bet may offered if the dealer face-up cards have a combined value of between 10 and 16, inclusive.

IV. Exemplary Blackjack Side-Bets on Combinations of Dealer and/or Player Cards

In another aspect, a method of playing a game of Blackjack involving a side-bet may be provided. The method may include accepting a primary wager from a plurality of players; dealing a combination of player face-up cards to each of the plurality of players; dealing a combination of dealer face-up cards to a dealer; determining a first face value of each combination of player face-up cards as the game progresses; and determining a second face value of the combination of dealer face-up cards as the game progresses. If the first face value of any combination of player face-up cards or the second face value of the combination of dealer face-up cards is equal to a specific value at any time during the game, the method may include offering the player the option of placing a secondary mid-game wager that the respective player or dealer having a face value of face-up cards equal to the specific value will go bust before acquiring Blackjack, a winning hand, or a hand of a certain value, such as between 18 and 21.

The specific value that triggers offering the side-bet to the player may be any value, including 10 or more. Preferably, the pre-determined specific value is between 2 and 9, inclusive. In one embodiment, the pre-determined specific value is 5, 6, and/or 7. As a result, the player may be offered the option of placing the secondary mid-game wager only when the face value of face-up cards belonging the respective player or dealer is the pre-determined specific value. Further, if the player has broken or won before the dealer needs to act on his or her hand, the secondary wager may be pushed or cancelled by the player, or doubled if other players remain alive. Alternatively, either the dealer or the player may force the dealer to play out the hand and force the side-bet to conclusion.

V. Exemplary Triggering Events for Offering Side-Bets on Going Bust

Table I below helps to illustrate exemplary triggering events for offering a mid-game side-bet that a dealer, the player, and/or a competing player will go bust before getting Blackjack, a winning hand, and/or a hand of a certain value, such as between 17 and 21 or between 18 and 21.

TABLE I

Exemplary Triggers for Offering Blackjack Side-bets of Going Bust

| Dealer's Initial Face-Up Card | Combined Face Value of Dealer's Face-Up Cards | Player's or Competing Player's Initial Face-Up Card | Combined Face Value of Player's or Other Player's Face-Up Cards |
|---|---|---|---|
| Any specific card - Ace, 2, 3, 4, 5, 6, 7, 8, 9, 10, Jack, Queen, or King | Any specific combined value | Any specific card - Ace, 2, 3, 4, 5, 6, 7, 8, 9, 10, Jack, Queen, or King | Any specific combined value |
| Any card between 2 and 9, inclusive | Any combined value between 2 and 9, inclusive | Any card between 2 and 9, inclusive | Any combined value between 2 and 9, inclusive |
| Any combination of 5, 6, and/or 7 | Any combination of 5, 6, and/or 7 | Any combination of 5, 6, and/or 7 | Any combination of 5, 6, and/or 7 |
| Any card less than 10 | Any combined value less than 10 | Any card less than 10 | Any combined value less than 10 |
| Any combination of 10 and face-cards | Any combined value 10 or more | Any combination of 10 and face-cards | Any combined value 10 or more |

As shown, triggering events for offering a mid-game side-bet that the dealer will go bust before getting Blackjack, a winning hand, and/or a hand of a certain value may be that (a) the dealer's initial face-up card is any specific card—Ace, 2, 3, 4, 5, 6, 7, 8, 9, 10, Jack, Queen, or King; any card between 2 and 9, inclusive; or a 5, a 6, or a 7, or any combination thereof; or (b) a combined face value of two or more of the dealer's face-up cards is any specific value; between 2 and 9, inclusive; or 5, 6, or 7, or any combination thereof. Triggering events for offering a side-bet that the player or a competing player will go bust before getting Blackjack, a winning hand, and/or a hand of a certain value may be that (c) the player's or a competing player's initial face-up card is any specific card—Ace, 2, 3, 4, 5, 6, 7, 8, 9, 10, Jack, Queen, or King; any card between 2 and 9, inclusive; or a 5, a 6, or a 7, or any combination thereof; or (d) a combined face value of two or more of the player's or the competing player's face-up cards, respectively, is any specific value; between 2 and 9, inclusive; or 5, 6, or 7, or any combination thereof.

Triggering events for offering a side-bet that a dealer or a player will go bust before getting Blackjack, a winning hand, and/or a hand of a certain value may be that the dealer's or the player's respective initial face-up card is less than a ten, or alternatively, a 10, a face-card, and/or an Ace. Triggering events for offering a side-bet that a dealer or a player will go bust before getting Blackjack, a winning hand, and/or a hand of a certain value may be that the dealer's or the player's respective combined value of face-up cards is less than ten, or alternatively, 10 or more, such as between 10 and 16, inclusive. Additional, fewer, and alternate triggering events may be used.

VI. Exemplary Playing Surface for Placing Blackjack Side-Bets of Going Bust

Figure 2:
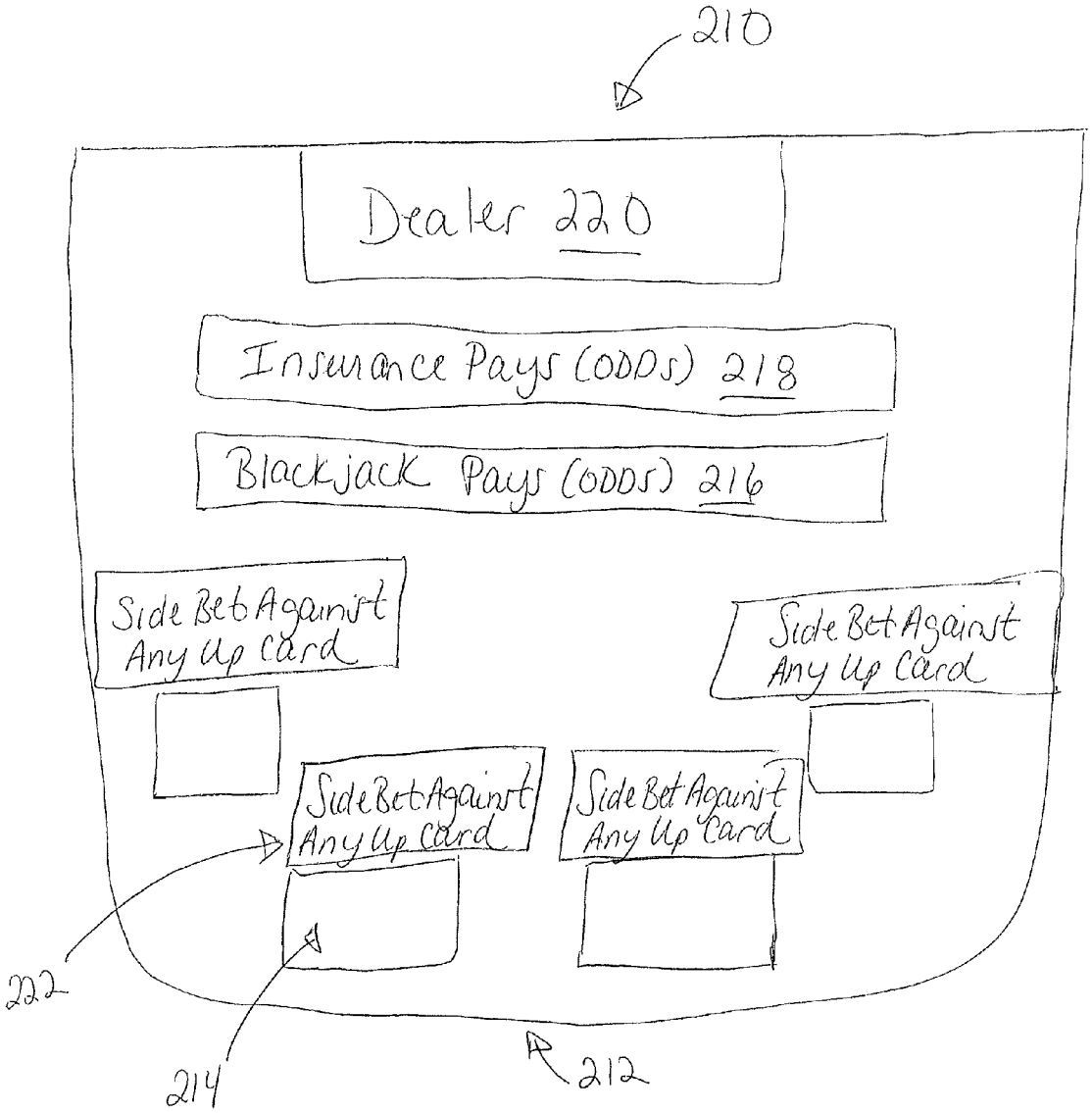
FIG. 2 illustrates an exemplary gaming surface for placing a Blackjack side-bet.

FIG. 2 illustrates an exemplary gaming surface for placing Blackjack side-bets of going bust. A Blackjack table may include a playing surface 210 that accommodates several player positions 212, several primary betting areas 214, guidelines for Blackjack bets 216 and insurance payouts 218, a dealer station 220, and several secondary betting areas 222. The playing surface 210 may include additional, fewer, or alternate features.

Each player position 212 may include a primary betting area 214 at which the respective player may place a primary bet. The primary bets may relate to the Blackjack game and/or other bets, such as bets associated with the dealer's, the player's, and/or the other players' cards. For instance, the primary bet may include an initial or pre-deal bet on the value of the dealer's, player's, or other players' cards, and/or whether the dealer or one of the players will go bust, win, or get Blackjack or other hand value. Additional, fewer, or other primary bets may be placed.

The guidelines for Blackjack bets 216 may include guidelines or payout odds offered for Blackjack, such as 2:1, 3:2, 2.5:1, or the like. The guidelines for insurance payouts 218 may also include guidelines or payout odds offered related to insurance options.

The playing surface 210 may include a dealer station 220. A dealer may deal a game of Blackjack to several players from the dealer station 220. The dealer station 220 may include chip holders. The dealer station 220 may include card dispensing devices and/or card collecting devices. The dealer station 220 may include additional, fewer, or alternate components.

The playing surface 210 may include a secondary betting area 222. The secondary betting area 222 may be used by each player to place side-bets before and/or during a game of Blackjack. The side-bet placed may be a wager on whether the dealer, the player, and/or other specific players will go bust during a game, such as going bust before getting Blackjack.

The secondary betting area 222 may facilitate side-bets based upon single card values or a combination of card face values being equal to a pre-determined value. For instance, in the embodiment shown, depending upon the dealer's initial face-up card, each player may be offered the opportunity to place a side-bet that the dealer will go bust before getting Blackjack, a winning hand, and/or a hand of a certain value, such as between 17 and 21. As an example, the side-bet may be that if the dealer takes one or more "hits," the dealer will go bust.

The secondary betting area 222 of the playing surface 210 may include a designated area for placing a side-bet based upon a single card face value, or a combination of card face values. The values shown on the playing surface 210 in the secondary betting area 222 may include any card value, and/or include odds associated with the bet, such as pre-determined odds, written or otherwise visibly marked onto the playing surface 210.

If the single card face value, or a combination of card face values, of the dealer is not the pre-determined specific value, such as not between 2 and 9, inclusive, or not a 5, a 6, or a 7, the player may not be offered a side-bet that the dealer will go bust. Additionally or alternatively, the player may be offered a side-bet if the player and/or other players have an initial card having a face value of a specific value, such as between 2 and 9, inclusive, the player based side-bet being that the player and/or other players will go bust either on the next card or before getting Blackjack, a winning hand, and/or a hand of a certain value, such as between 18 and 21. The player may also be offered a side-bet if the player and/or other players have a combination of card face values that equals a specific value, such as between 2 and 9, inclusive, or 5, 6, and/or 7, in one embodiment.

The odds offered may be card dependent. As an example, the odds offered based upon a single card face value and/or combination of card face values of 5 may be different than those offered for face values of 6 and/or 7. For instance, if the dealer's initial face card is 5, the odds offered to the player that the dealer will go bust before getting Blackjack may be 1:1 or other odds. If the dealer's initial face card is 6, the odds offered to the player that the dealer will go bust before getting Blackjack may 3:2 or other odds. If the dealer's initial face card is 7, the odds offered to the player that the dealer will go bust before getting Blackjack may be 2:1 or other odds. Additional, fewer, or alternative odds may be offered. As an example, the odds offered may be calculated based upon all of the dealer's current cards, including or excluding the hole card; all of the dealer's and players' cards; all of the face-up cards (the dealer's face-up card and each player's cards); all of the cards dealt during the current game and one or more previous games using the same deck; or other card combinations.

VII. Exemplary Methods of Offering Blackjack Side-Bets of Going Bust

Figure 3:
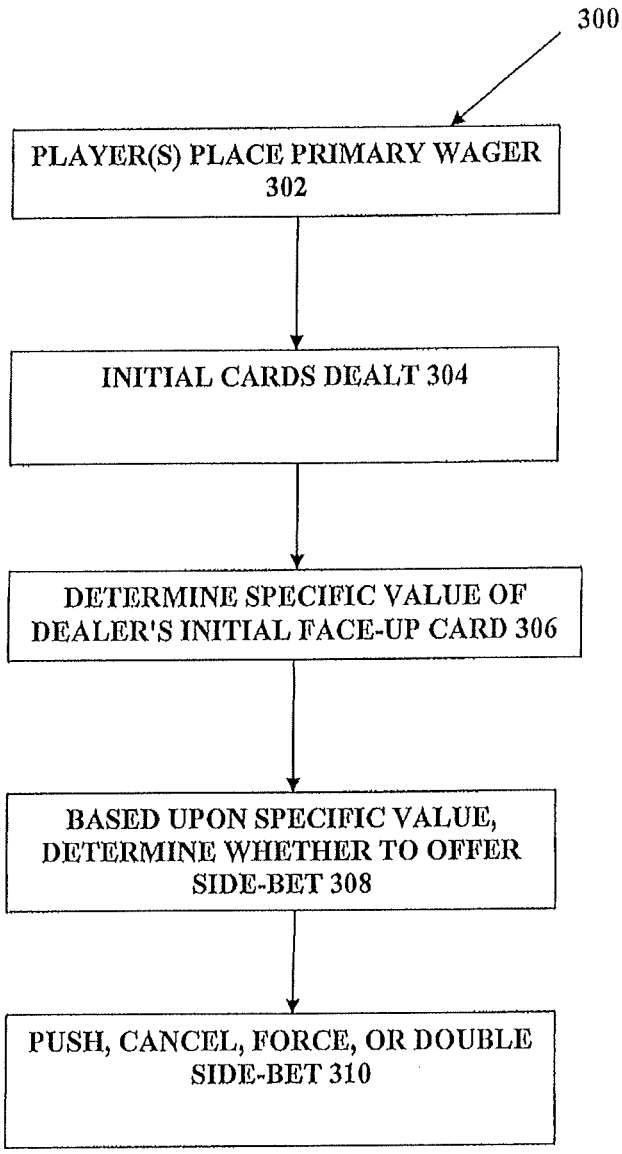
FIGS. 3, 3A and 3B illustrate exemplary methods of placing a Blackjack side-bet.

FIG. 3 illustrates an exemplary method of offering a Blackjack side-bet 300 that is triggered by the dealer's initial face-up card being a specific value. The method of offering a Blackjack side-bet 300 may include the player(s) placing a primary wager 302, the dealer dealing the initial cards 304, determining the specific value of the dealer's initial face-up card 306, offering a side-bet in certain situations 308, and pushing, canceling, forcing, or doubling the side-bet 310. The method may include additional, fewer, or alternative steps.

The method of offering a Blackjack side-bet 300 may include each of the players making a primary wager 302. The primary wager may be an amount that is wagered on the player winning the hand or getting Blackjack. Alternatively or additionally, the primary wager may be an initial wager that the dealer, the player, and/or one or more competing players will go bust.

The method of offering a Blackjack side-bet 300 may include dealing the initial cards 304. The initial cards dealt, which may be dealt before determining whether or not to offer a side-bet, may include dealing a single card, dealing an initial single card to each player and the dealer, or dealing the first two rounds to each player and the dealer. For instance, the initial two rounds may be dealt, with the dealer having a face-up card and a hole card, and each of the players having two face-up cards.

In one embodiment, the method of offering a Blackjack side-bet 300 may include determining whether or not to offer a mid-game side-bet based upon a specific value of the dealer's initial face-up card 306. Additionally or alternatively, the determination of whether or not to offer a mid-game side-bet may be based upon a combination of the dealer's face-up cards, the player's cards, and/or the other players' cards. For instance, the side-bet may be whether the dealer, the player, and/or one of the specific players will go bust, assuming that the dealer, the player, and/or the one of the specific players is playing with the intent to win the game and in accordance with best practices of not going bust during a game of Blackjack.

Figure 3A:
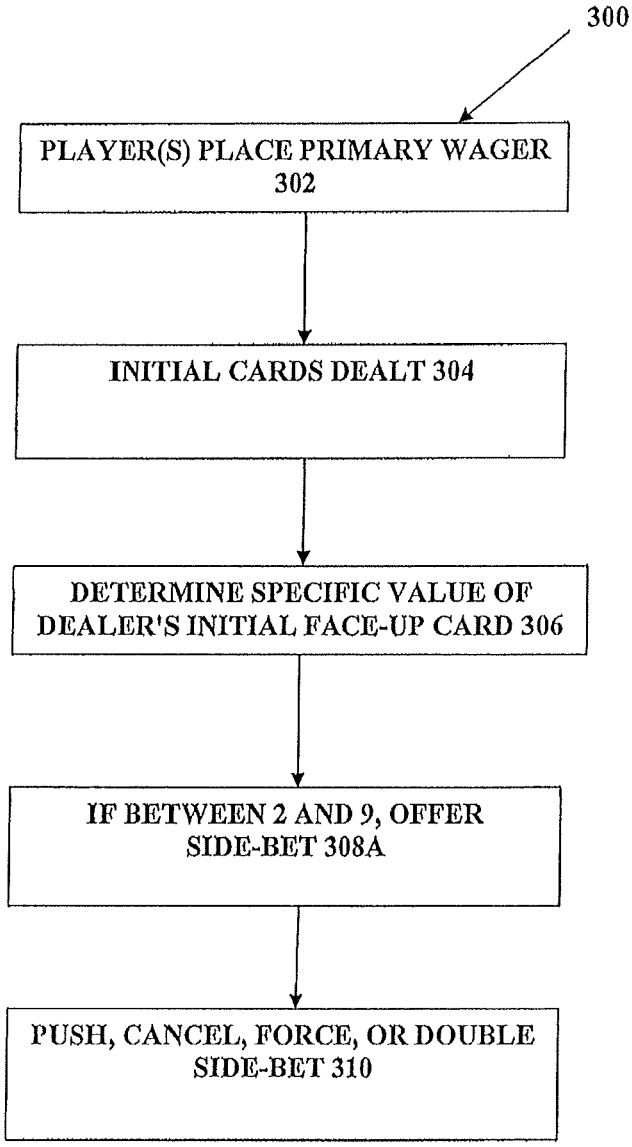
Figure 3B:
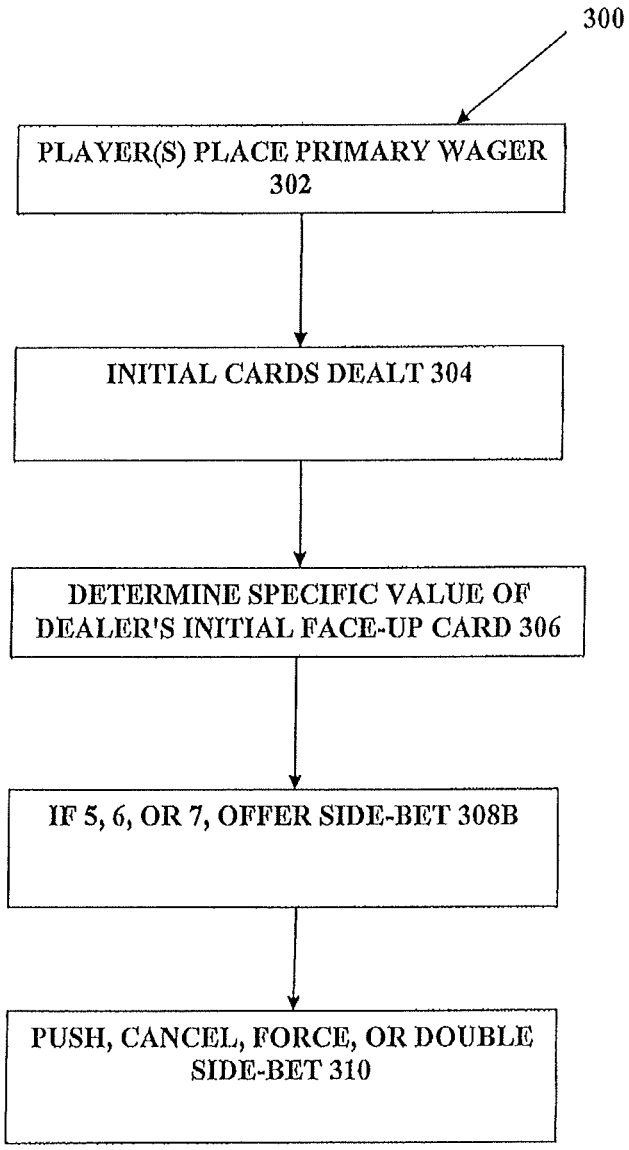

FIG. 3 illustrates that the side-bet may be triggered by any specific card value 308. For instance, the side-bet may be offered if the initial face-up card of the dealer is an Ace, 2, 3, 4, 5, 6, 7, 8, 9, 10, Jack, Queen, and/or King. FIG. 3A illustrates another embodiment in which the side-bet may be triggered by an initial face-card of the dealer that is between 2 and 9, inclusive 308A. FIG. 3B illustrates another embodiment in which the side-bet may be triggered by the dealer's initial face-up card being a 5, a 6, or a 7 308B.

In the embodiment of FIG. 3B, the method of offering a Blackjack side-bet 300 may include offering a mid-game side-bet that the dealer will go bust 308 before getting Blackjack, a winning hand, and/or a hand of a certain value if the dealer's initial face-up card is a 5, a 6, and/or a 7. On the other hand, if the dealer's initial face-up card is an Ace, 2, 3, 4, 8, 9, 10, Jack, Queen, or King, the method may not offer a mid-game side-bet that the dealer will go bust before getting Blackjack, a winning hand, and/or a hand of a certain value. Instead, the game of Blackjack may continue as normal, such as with normal or modified Blackjack rules applying.

Additionally or alternatively, the mid-game side-bet may be offered based upon a combination of the dealer's face-up cards, such as being between 2 and 9, inclusive, or being a 5, a 6, and/or a 7. The mid-game side-bet may also be offered if the player's or another player's initial face-up card, or a combination of card face values, is between 2 and 9, inclusive, or being a 5, a 6, and/or a 7. For instance, after the initial round is dealt, the player may be offered a side-bet that the dealer, the player, and/or another specific player will go bust before getting Blackjack, a winning hand, or a hand of a certain value, such as between 18 and 21, between 19 and 21, or a hand of either 20 or 21.

Alternatively, the mid-game side-bet may also be offered if the player's or another player's initial face-up card, or a combination of card face values, is a 5 and/or a 6. In such a case, after the initial round is dealt, the player may be offered a side-bet that the dealer, the player, and/or another specific player will go bust before getting Blackjack, a winning hand, or a hand of a certain value, such as between 17 and 21.

The method 300 may include pushing, canceling, forcing and/or doubling the side-bet 310. If all of the players have broken or won before the dealer needs to act on his or her hand, any side-bet placed may be pushed and there may be no action taken on the side-bets. If a player goes bust or gets Blackjack, he or she may cancel any side-bet placed. Also, if the player goes bust and other players remain in the game, the player may be given the option of canceling and/or doubling his or her side-bet that the dealer and/or other players will go bust.

If all of the players have broken or won before the dealer needs to act on his or her hand, the dealer may be given the option of playing out his or her hand with the side-bets still alive. If the dealer gets Blackjack and/or a hand of a certain value, such as between 18 and 21, the dealer may win, while if the dealer goes bust beforehand, the player(s) win.

Alternatively or additionally, if all of the players have broken or won before the dealer needs to act on his or her hand, the players may be given the option of forcing the dealer to play out the hand with the side-bet remaining alive. Again, if the dealer gets Blackjack and/or a hand of a certain value, the dealer may win, while if the dealer goes bust beforehand, the player(s) win. The odds offered that the dealer will go bust before getting Blackjack and/or a hand of a certain value, may be reduced and/or different from those offered on the original mid-game side-bet.

Figure 4:
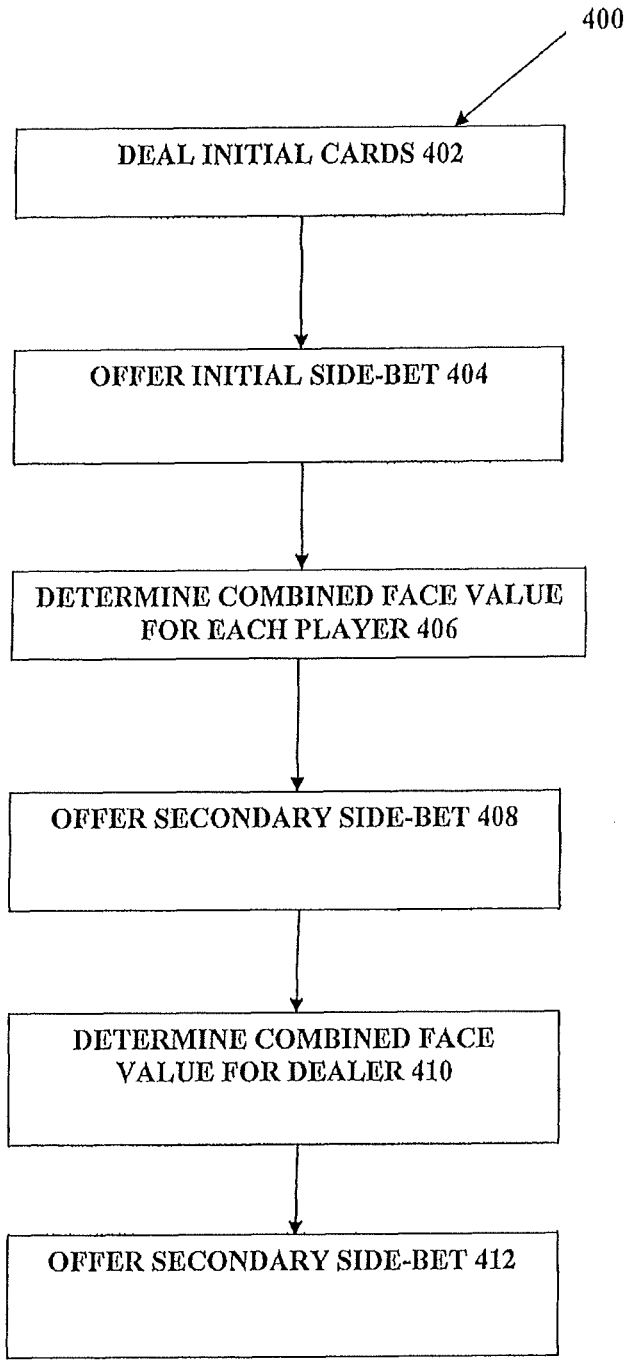
FIG. 4 illustrates another exemplary method of placing a Blackjack side-bet.

FIG. 4 illustrates an exemplary method of offering a Blackjack side-bet 400 that may be triggered by a combined value of the face-up cards 400. The method of offering a Blackjack side-bet 400 may include dealing the initial cards 402, offering an initial side-bet 404, determining a combined value of face-up cards for each player 406, offering a secondary Blackjack side-bet 408, determining a combined value of face-up cards for the dealer 410, and offering a secondary Blackjack side-bet 412. The method may include additional, fewer, or alternative steps.

The method of offering a Blackjack side-bet 400 may include dealing the initial cards 402. The initial cards dealt may include a single card, a single initial round, or both initial rounds for a game of Blackjack. Other initial cards may be dealt.

The method of offering a Blackjack side-bet 400 may include offering an initial side-bet 404. The initial side-bet may be offered if the dealer's initial face-up card, and/or the player's or another player's initial face-up card, has a face value of a pre-determined specific value, including the specific values detailed herein. As an example, the initial side-bet may be that the dealer and/or the player(s) with an initial face-up card of a 5, a 6, and/or a 7 will go bust before getting Blackjack, a winning hand, and/or a hand of a certain value, such as between 18 and 21. Alternatively, the initial side-bet may be that the dealer and/or the player(s) with an initial face-up card of a 5 and/or a 6 will go bust before getting Blackjack, a winning hand, and/or a hand of a certain value, such as between 17 and 21.

The method of offering a Blackjack side-bet 400 may include calculating a combined value of face-up cards for each player 406. After a player is dealt his second card, the combined value of his or her face-up cards may be determined. Also, as each player's turn progresses, with each new hit, the combined value of the player's face-up cards may be re-determined.

The method of offering a Blackjack side-bet 400 may include offering a secondary side-bet 408 based upon the amount of the combined value of face-up cards calculated for a player. For instance, if at any point, the combined value of the player's face-up cards is a pre-determined specific value (such as between 2 and 9, inclusive, or a 5, a 6, and/or a 7, or other values indicated in Table I above), the player and/or the other players may be offered a secondary side-bet that the player will go bust before getting Blackjack, a hand of a certain value, and/or other winning hand (assuming that the player is playing in accordance with best practices not to go bust during a game of Blackjack).

The method of offering a Blackjack side-bet 400 may include calculating a combined value of face-up cards for the dealer 410. As the dealer's turn progresses, the combined value of his or her face-up cards, or even all of his or her cards, may be determined. With each new hit, the combined value of the dealer's face-up cards, even all of the dealer's cards, may be determined.

The method of offering a Blackjack side-bet 400 may include offering a secondary side-bet based upon the dealer's combined cards 412. For instance, if at any point during the game, the combined value of the dealer's face-up cards is the pre-determined specific value (such as between 2 and 9, inclusive, or a 5, a 6, and/or a 7, or other values indicated in Table I above), the players may be offered a secondary side-bet that the dealer will go bust before getting Blackjack, a hand of a certain value, and/or other winning hand.

Additionally or alternatively, the secondary side-bet that the dealer will go bust before getting Blackjack or a winning hand may be based upon all of the dealer's and players' face-up cards from the current hand and/or cards from previous hands. Other secondary side-bets may be offered.

The odds calculated for each side-bet may be the same or different. For instance, the odds based upon individual card face values of 5, 6, or 7 may be different. The odds based upon combined card face values of 5, 6, or 7 may be different. The odds based upon individual or combined card face values may be the same or different.

For instance, the odds offered that a dealer with a 2 and 3 combination (combined face value 5) will go bust may be different than the odds offered that a dealer with an initial face-up card of a 5 will go bust. The odds offered that a dealer with an initial face-up card of 5 will go bust may be different than the odds offered that a dealer with an initial face-up card of a 6 will go bust. The odds offered that a dealer with an initial face-up card of a 5 or a 6 will go bust may be different than the odds offered that a dealer with an initial face-up card of a 7 will go bust. The odds offered may be based upon whether conventional Blackjack or modified Blackjack rules are being applied.

In addition to real world casino gaming, the present embodiments for placing Blackjack side-bets may be implemented via computer hardware and/or software. The side-bet rules discussed herein may be programmed in various computer languages, as one of skill in the computer or software art would recognize, such as in C, C++, Java, object orientated code, etc. A software-based Blackjack game employing the side-bet rules discussed herein may be accessible via the internet, such as via virtual or online gaming casinos, or iPhone apps. Other software-based embodiments may be utilized.

While several arrangements of the invention have been described, it will be understood that it is capable of still further modifications and this application is intended to cover any variations, uses, or adaptations of the invention, following in general the principles of the invention and including such departures from the present disclosure as to come within knowledge or customary practice in the art to which the invention pertains, and as may be applied to the essential features hereinbefore set forth and falling within the scope of the invention or the limits of the appended claims.

While the invention has been described above by reference to various embodiments, it should be understood that many changes and modifications can be made without departing from the scope of the invention. The description and illustrations are by way of example only. Many more embodiments and implementations are possible within the scope of this invention and will be apparent to those of ordinary skill in the art. The various embodiments are not limited to the described environments and have a wide variety of applications.

It is intended in the appended claims to cover all such changes and modifications which fall within the true spirit and scope of the invention. Therefore, the invention is not limited to the specific details, representative embodiments, and illustrated examples in this description. Accordingly, the invention is not to be restricted except in light as necessitated by the accompanying claims and their equivalents.

What is claimed is:

1. A method of playing a game of Blackjack implemented on a processor and involving a side-bet, the method comprising:

accepting a primary wager from a player by utilizing the processor;

dealing a combination of player face-up cards to the player;

dealing a combination of dealer face-up cards to a dealer;

determining a first face value of the combination of player face-up cards as the game progresses by utilizing the processor;

determining a second face value of the combination of dealer face-up cards as the game progresses by utilizing the processor; and if the first face value of the combination of player face-up cards or the second face value of the combination of dealer face-up cards is equal to a specific value during the game, offering, by utilizing the processor, the player an option of placing a secondary mid-game wager that the player or dealer having a face value of face-up cards equal to the specific value will go bust before acquiring Blackjack or a winning hand, wherein the specific value is between 2 and 9, inclusive, such that the player is offered the option of placing the secondary mid-game wager only when the face value of face-up cards belonging to the player or dealer is between 2 and 9.

2. The method of claim 1, wherein the game of Blackjack has rules that require the dealer to draw until reaching 17 and the secondary mid-game wager loses when the dealer receives a standing hand of 17, 18, 19, 20 or 21.

3. The method of claim 1, wherein the secondary mid-game wager may be asked for by all players in the game at one time similar to an insurance bet.

4. The method of claim 1, wherein the secondary mid-game wager may be asked for as the player acts on individual hands of the player.

5. The method of claim 1, wherein if by mistake a hole card is exposed prematurely, there may be no more side-bets allowed, but all existing side-bets will have action and be allowed to proceed.

6. The method of claim 1, wherein the game of Blackjack has rules that require the dealer to draw until reaching 18 and the secondary mid-game wager loses when the dealer receives a standing hand of 18, 19, 20 or 21.

7. A method of playing a game of Blackjack implemented on a processor and involving a side-bet, the method comprising:

accepting a primary wager from a player by utilizing the processor;

dealing a combination of player face-up cards to the player;

dealing a combination of dealer face-up cards to a dealer;

determining a first face value of the combination of player face-up cards as the game progresses by utilizing the processor;

determining a second face value of the combination of dealer face-up cards as the game progresses by utilizing the processor; and if the first face value of the combination of player face-up cards or the second face value of the combination of dealer face-up cards is equal to a specific value during the game, offering, by utilizing the processor, the player an option of placing a secondary mid-game wager that the player or dealer having a face value of face-up cards equal to the specific value will go bust before acquiring Blackjack or a winning hand, wherein the specific value is 5, 6, and/or 7 such that the player is offered the option of placing the secondary mid-game wager only when the face value of face-up cards belonging to the player or dealer is 5, 6, and/or 7.

8. The method of claim 7, wherein the game of Blackjack has rules that require the dealer to draw until reaching 17 and the secondary mid-game wager loses when the dealer receives a standing hand of 17, 18, 19, 20 or 21.

9. The method of claim 7, wherein the secondary mid-game wager may be asked for by all players in the game at one time similar to an insurance bet.

10. The method of claim 7, wherein the secondary mid-game wager may be asked for as the player acts on individual hands of the player.

11. The method of claim 7, wherein if by mistake a hole card is exposed prematurely, there may be no more side-bets allowed, but all existing side-bets will have action and be allowed to proceed.

12. The method of claim 7, wherein the game of Blackjack has rules that require the dealer to draw until reaching 18 and the secondary mid-game wager loses when the dealer receives a standing hand of 18, 19, 20 or 21.

13. A method of playing a game of Blackjack implemented on a processor and involving a side-bet, the method comprising:

accepting a primary wager from a player by utilizing the processor;

dealing a combination of player face-up cards to the player;

dealing a combination of dealer face-up cards to a dealer;

determining a first face value of the combination of player face-up cards as the game progresses by utilizing the processor;

determining a second face value of the combination of dealer face-up cards as the game progresses by utilizing the processor; and if the first face value of the combination of player face-up cards or the second face value of the combination of dealer face-up cards is equal to a specific value during the game, offering, by utilizing the processor, the player an option of placing a secondary mid-game wager that the player or dealer having a face value of face-up cards equal to the specific value will go bust before acquiring Blackjack or a winning hand, wherein the specific value is 2, 3, 4, 5, 6, 7, 8, 9, 10, ace, jack, queen, or king, inclusive, such that the player is offered the option of placing the secondary mid-game wager when the face value of face-up cards belonging to the player or dealer is 2, 3, 4, 5, 6, 7, 8, 9, 10, ace, jack, queen, or king.

14. The method of claim 13, wherein the game of Blackjack has rules that require the dealer to draw until reaching 17 and the secondary mid-game wager loses when the dealer receives a standing hand of 17, 18, 19, 20 or 21.

15. The method of claim 13, wherein the secondary mid-game wager may be asked for by all players in the game at one time similar to an insurance bet.

16. The method of claim 13, wherein the secondary mid-game wager may be asked for as the player acts on individual hands of the player.

17. The method of claim 13, wherein if by mistake a hole card is exposed prematurely, there may be no more side-bets allowed, but all existing side-bets will have action and be allowed to proceed.

18. The method of claim 13, wherein the game of Blackjack has rules that require the dealer to draw until reaching 18 and the secondary mid-game wager loses when the dealer receives a standing hand of 18, 19, 20 or 21.

19. The method of claim 13, further comprising cancelling the secondary mid-game wager if the player goes bust.

20. The method of claim 13, further comprising doubling the secondary mid-game wager if the player goes bust and other players remain in in the game.

* * * * *